United States Patent [19]

Justice et al.

[11] 4,239,289

[45] Dec. 16, 1980

[54] MANEUVERABLE FULL FACE MINER

[75] Inventors: James C. Justice; Frank A. Delli-Gatti, both of Beckley, W. Va.

[73] Assignee: Coaltex, Incorporated, Beckley, W. Va.

[21] Appl. No.: 20,492

[22] Filed: Mar. 14, 1979

[51] Int. Cl.[3] ..... E21C 25/52

[52] U.S. Cl. ..... 299/18; 299/31; 299/33; 299/43; 299/45

[58] Field of Search ..... 299/64, 43, 45, 31, 299/33, 18

[56] References Cited

U.S. PATENT DOCUMENTS

| | | | |
|---|---|---|---|
| 2,202,584 | 5/1940 | Holmes | 299/64 |
| 3,169,796 | 2/1965 | Long et al. | 299/64 |
| 3,194,603 | 7/1965 | Gonski et al. | 299/64 |
| 4,037,875 | 7/1977 | Justice | 299/18 |
| 4,046,424 | 9/1977 | Montgomery | 299/56 |

FOREIGN PATENT DOCUMENTS

| | | | |
|---|---|---|---|
| 559656 | 4/1960 | Belgium | 299/45 |
| 1223786 | 9/1966 | Fed. Rep. of Germany | 299/45 |

*Primary Examiner*—William F. Pate, III

*Attorney, Agent, or Firm*—Cushman, Darby & Cushman

[57] ABSTRACT

A full face miner including a simplified conveying arrangement and designed for easy maneuverability into and out of mine sites. A plow operatively mounted to and longitudinally movable with each of a pair of rotatable cutting heads of the miner provide for the conveyance of cut coal to a middle conveying portion for ultimate transport away from the mine site. The mounting mechanism for the cutting heads is designed so that at least the end portions thereof are movable from a position generally parallel to the mine face to a position generally perpendicular to the mine face and extending in front of and in line with the central conveying means, for ease of withdrawal from the mining area. A motive power source, such as a powered crawler or powered wheels, is provided which is movable into operative engagement with the ground to transport the miner to and from the mining site when in a collapsed position.

15 Claims, 6 Drawing Figures

MANEUVERABLE FULL FACE MINER

BACKGROUND AND SUMMARY OF THE INVENTION

The invention relates to improvements in full face miners, such as shown in U.S. Pat. No. 4,037,875 (the disclosure of which is hereby incorporated by reference herein). While prior full face miners are very useful in the mining of low-coal seams and the like while providing maximum miner safety and complying with applicable Federal Safety Regulations, for some uses (especially where the face to be mined is about 20 feet wide or less) the conveying mechanisms for prior full face miners are unduly complex, and there are problems of maneuverability of the miner to and from the mine site. According to the present invention, both such drawbacks associated with prior full face miners are overcome, providing a simplified and more maneuverable structure.

According to the present invention, the paddle-type conveying means normally associated with prior full face miners is replaced by a plow operatively mounted to and longitudinally movable with each of the cutting heads of the miner. The plows move the cut coal or the like toward the center of the miner, and at the center a conveying mechanism—such as a conveyor belt assembly—is provided for conveying the coal away from and generally perpendicular to the face being mined. The plow arrangement is much simpler than the paddle-type conveyor arrangement, does not require an accessory power source, and is as suitable for accomplishing the end results, especially where the face to be mined is relatively narrow (e.g. 20 feet or less).

According to another aspect of the present invention, a full face miner is provided with means supporting the cutting head mounting means so that at least the end portions thereof are movable from a position generally parallel to the mine face to a position generally perpendicular to the mine face and extending in front of and in line with a central conveying means for the miner. Utilizing such an arrangement, the minimum width possible of the miner, considering the dimensions of the cutting head and central conveying means, is provided, making the structure more maneuverable than prior proposals for similar machines (e.g. see U.S. Pat. No. 4,046,424). A simple pivot arrangement may be provided as the supportive means.

In order to facilitate the movement of the miner to and from the mine site in the collapsed position, while not interfering with its operation during mining, powered motive means are provided operatively connected to the cutting head mounting means for supporting and moving the entire miner. Such powered motive means may take the form of a crawler attached to each end of the cutting head mounting means, or a pair of wheels associated with each end of the cutting head mounting means. Means are provided for mounting the powered motive means for movement from the first position wherein they are spaced from the ground with the end portions of the cutting head mounting means generally parallel to the mine face, to a second position wherein they are in operative engagement with the ground with the end portions of the cutting head mounting means extending generally perpendicularily to the mine face. In this position, the powered motive means support the entire miner for movement. This eliminates the necessity for a central bulky carrier arrangement (such as in U.S. Pat. No. 4,046,424) while still providing the ease of maneuverability required.

It is the primary object of the present invention to provide an improved full face miner. This and other objects of the invention will become clear from an inspection of the detailed description of the invention, and from the appended claims.

DETAILED DESCRIPTION OF THE DRAWINGS

Figure 3:
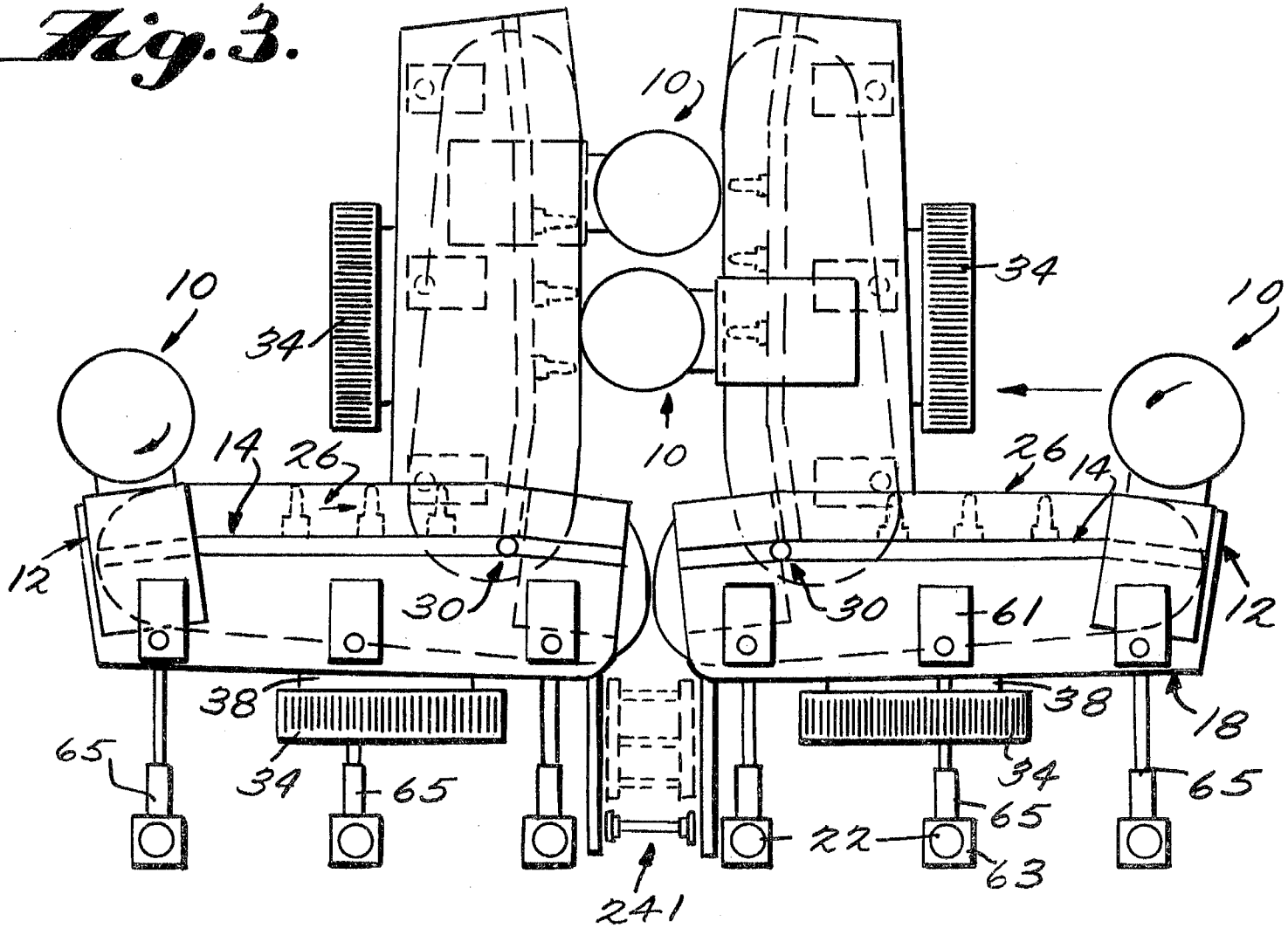
FIGS. 3 and 5 are top plan schematic views of exemplary collapsible miners according to the present invention, utilizing alternative motive powered means.
Figure 5:
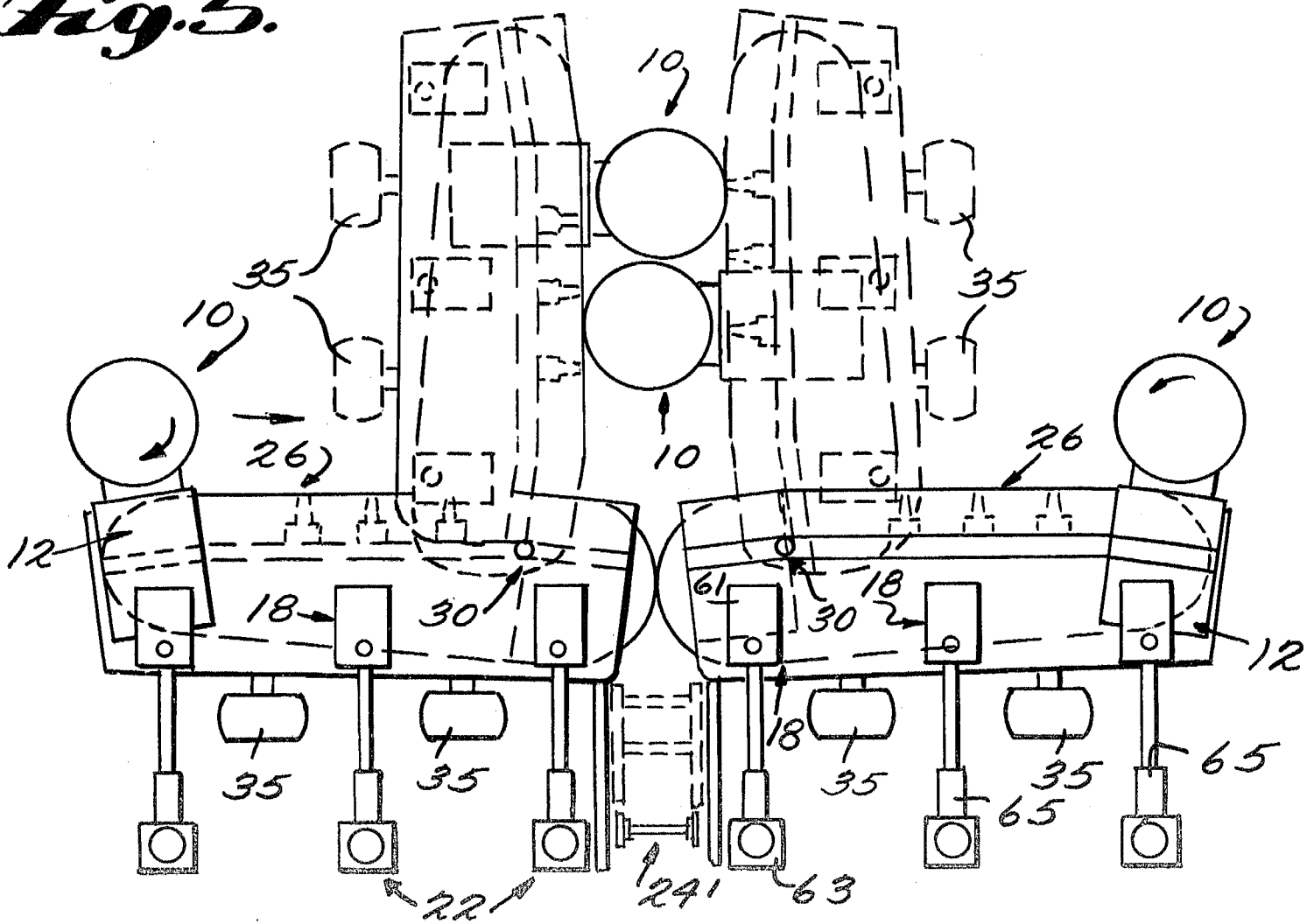

An exemplary full face miner according to the present invention is illustrated schematically in the drawings. The miner includes at least one, and preferably a pair of cutting heads 10, means 12 for rotating each of the cutting heads about its axis to effect cutting, means 14 for mounting the cutting heads 10 for reciprocal longitudinal movement toward and away from each other to effect shearing along the face being mined, means (not shown) for moving the cutting heads and the mounting means in reciprocal longitudinal movement to effect shearing, means 18 for supporting the roof of the cut seam and for anchoring the mounting means 14 in stationary position within the seam during reciprocal movement of the cutting heads with respect to the mounting means 14; and means 22 for sumping (advancing toward the face being cut) the cutting heads 10. Such structures are shown in more detail and described in U.S. Pat. No. 4,037,875, the disclosure of which is hereby incorporated by reference herein. As shown in the drawings, the embodiment of the supporting means 18 illustrated in the drawings includes an anterior most supporting shelf 61, while the sumping means 22 comprises a distinct rearward ram-mounted supporting shelf 63, and a horizontally adjustable ram 65. Additionally, a central conveyor 24, as in FIG. 1, or 24', as in FIGS. 3 and 5, is provided for conveying cut material (coal) away from and perpendicular to the face being mined.

According to one aspect of the present invention, conveying means 4 conveying cut material away from the face to be mined also includes means for conveying coal or like cut material along the face being mined, such means consisting essentially of a plough 25 operatively mounted to and longitudinally movable with each of the cutting heads 10. As the cutting head reciprocate back anf forth toward and away from each other, the plows will push all cut material toward the central conveyor 24 during the movement of the cutting heads 10 toward each other. The plow 25 arrangement is simple and inexpensive, and requires no separate drive mechanism as is necessary with paddle-type conveyors or the like, and is especially eminently suitable for mines where the face being mined is about 20 feet or less. The central conveyor 24 may take any of a variety of forms, such as a conventional conveyor belt which continuously transports cut coal or the like from the ground upwardly to the discharge end thereof, which in turn is connected to any other type of suitable conveying means disposed at the rear thereof (such as another conveyor belt arrangement).

The embodiment of the invention illustrated in FIGS. 3 through 6 is shown with a paddle-type conveying mechanism 26, which includes a central support 24' for the paddle conveyor, such conveying means being shown more specifically in U.S. Pat. No. 3,314,723, the disclosure of which is hereby incorporated by reference herein. However, it is to be understood that a plow 25 or the like may be associated with the structures illustrated in FIGS. 3 through 6 also.

In FIGS. 3 through 6, miners are provided which are readily maneuverable for ease of entry and exit from the mine face. Means are provided for supporting the cutting head mounting means 14 so that at least the end portions thereof are movable from a position generally parallel to the mine face (solid line in FIGS. 3 and 5) to a position generally perpendicular to the mine face and extending in front of and in line with the central conveying means 24' (dotted line in FIGS. 3 and 5). The supporting means may take the form of a conventional pivot and slide arrangement 30 which allows the relative movement indicated, the mounting portions 14 being spaced apart in the collapsed position a distance corresponding generally to the diameter of the cutting heads 10, which are preferably rotatable about vertical axes. Alternatively, the central portion of the mounting means 14 could be held stationary while the end portions were pivoted thereabout by a simple pivot mechanism. The sumping means 22 are preferably releasably mounted to the mounting means 14 so that they can be removed before pivoting of the mounting means 14 to their collpased position, or the sumping means 22 may be pivotal with respect to the mounting means 14 so that they too collapse to some extent. In the position illustrated in dotted line in FIGS. 3 and 5, the weight distribution of the miner is good and it has a minimum effective length so that it may be readily moved to and withdrawn from the mine site.

Preferably, powered motive means are operatively connected to the mounting means 14 for supporting and moving the entire miner. Such powered motive means may take the form of crawlers 34 (FIGS. 3 and 4), or pairs of wheels 35 (see FIGS. 5 and 6). The crawlers 34 include a supporting structure 38 which contains the motive powered force (e.g. electric motor), suitable shafts, bearings, and supports, and the like. Each wheel 35 also includes a similar driving and support structure 39 (see FIG. 6). Whichever motive means 34, 35 is utilized, it provides a simple relatively inexpensive structure that does not interfere with the normal operation of the miner, yet it can be called into play to move the miner in the collapsed position.

Figure 4:
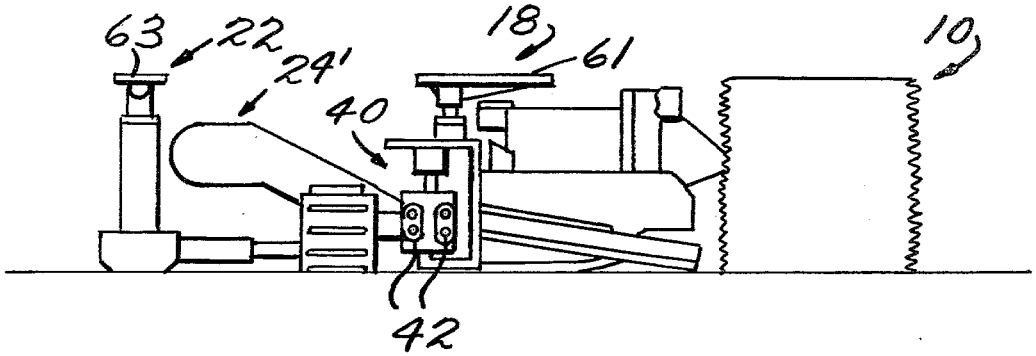
FIGS. 4 and 6 are schematic side crosssectional views, with portions removed for clarity, of the miners of FIGS. 3 and 5 respectively.
Figure 6:
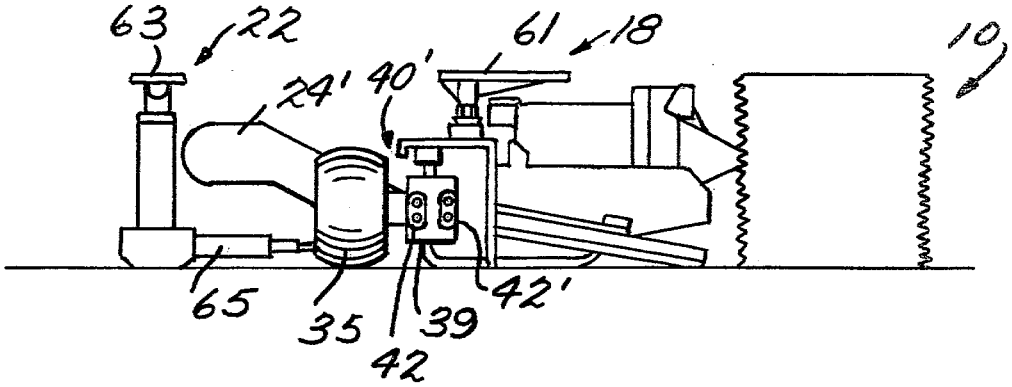

The miner illustrated in FIGS. 3 through 6 further comprises means 40 for mounting the powered motive means 34, 35 for movement from a first position wherein they are spaced from the ground and the end portions of the mounting means 14 are generally parallel to the mine face, to a second position wherein they are in operative engagement with the ground (see FIGS. 4 and 6) with the mounting means 14 extending generally perpendicularly to the mine face. For clarity, the crawlers 34 and wheels 35 are shown in engagement with the ground in FIGS. 4 and 6, although in those positions of the miner, they would normally be elevated off the ground, and in the case of the crawlers 34 would be elevated higher than the height of the rams 65 off of the ground so as not to interfere with the sumping action of the rams 65 and their cooperating platform support 63. In FIG. 4, the means 40 are shown simply as a hydraulic ram or the like, with guides 42 being provided associated with the crawler mechanism 38 for guiding up and down movement of the crawler 34; in FIG. 6, a similar hydraulic ram is shown mounted with the wheel mechanism 39, with vertical guides 42' being provided which cooperate with structures stationary with respect to the mounting means 14 to guide up and down movement of the wheels 35.

Figure 1:
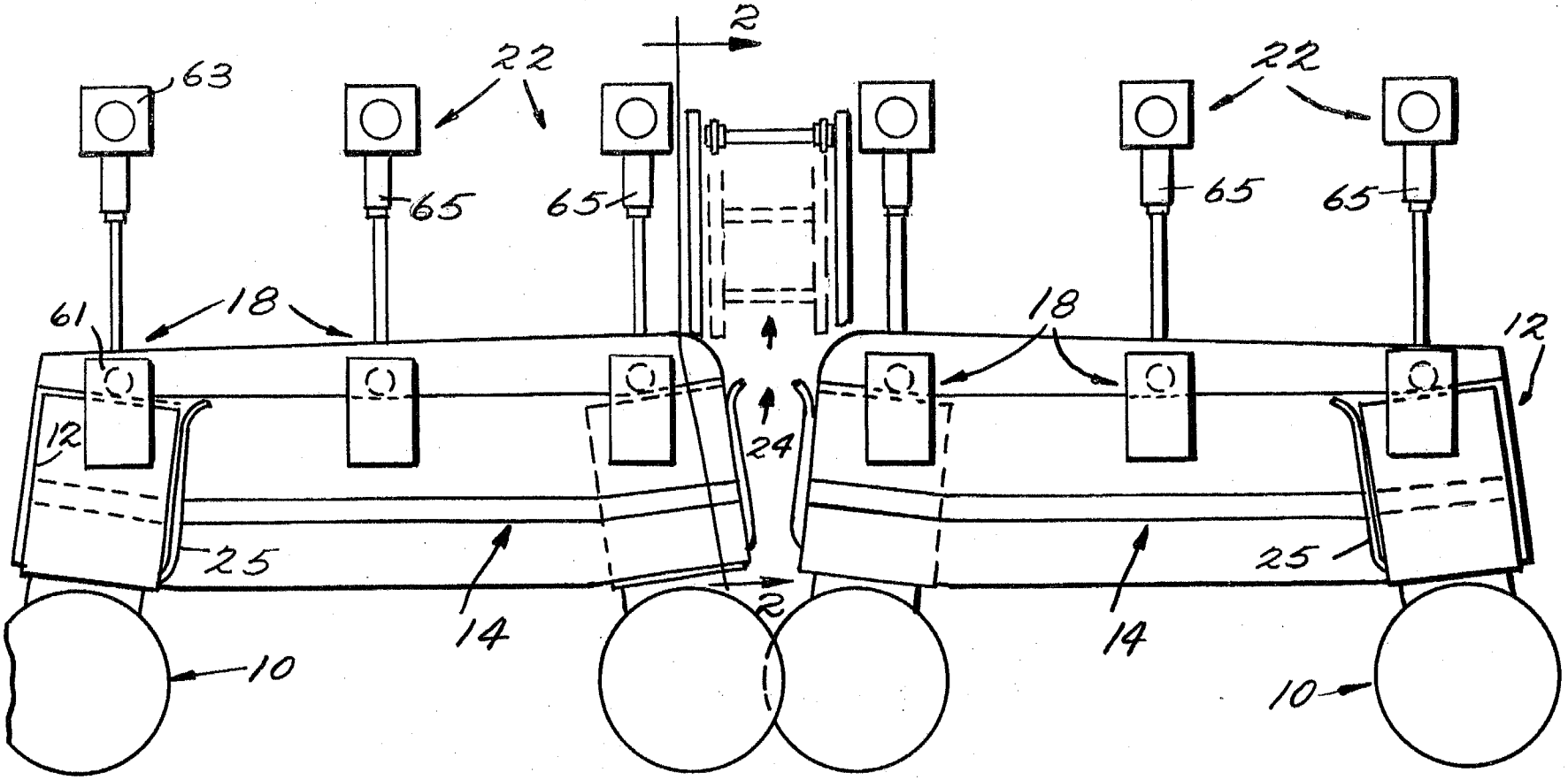
FIG. 1 is a top plan schematic view of an exemplary full face miner according to the invention utilizing plow conveyors.
Figure 2:
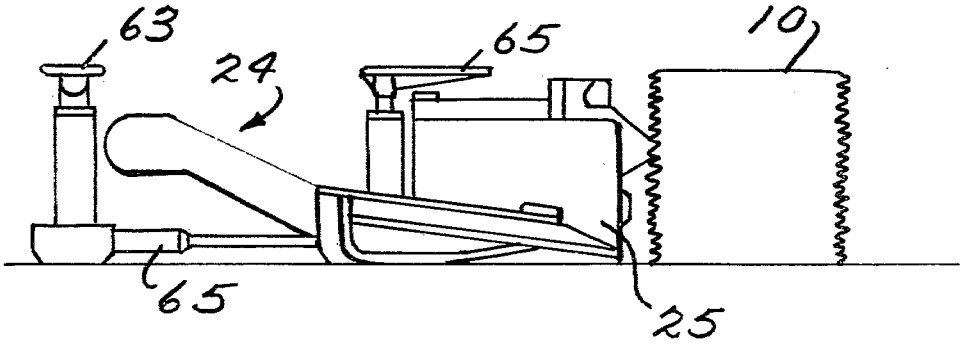
FIG. 2 is a side view taken along lines 2—2 of FIG. 1.

In an exemplary operation of the miner of FIGS. 1 and 2, the cutting heads 10 are rotated by the drive mechanisms 12, and are moved toward and away from each other along the mounting means 14 to effect cutting of the mine face, as they move toward each other the plows 25 plowing the cut material into engagement with the central conveying mechanism 24 to ultimately be transported perpendicular to and away from the mine face. After the mine face has been completely traversed, the cutting heads 10 are moved back away from each other, and the entire miner is sumped forwardly by cooperative operation of the means 18, 22, as described in U.S. Pat. No. 4,037,875.

In a typical operation of the structure of FIGS. 3 and 4, the cylinder 40 will normally maintain the crawler 34 so that it is raised off of the ground, above the middle ram 65 of the sumping means 22. The cutting heads 10 operate, the conveying means 26, 24' convey, and the sumping means 22 operate in basically the same manner as corresponding structures in the FIG. 1 embodiment. When mining of a particular face has been completed, in order to easily maneuver the miner away from the mine site, the rams 65 are detached from the mounting means 14, and each of the side units forming the mounting means 14 are pivoted and slid about the mechanism 30 to the dotted line position illustrated in FIG. 3. At this position, the cylinder 40 is actuated to move the crawler 34 into engagement with the ground to elevate the entire structure slightly off of the ground, the vertical movement thereof being guided by the vertical guides 42. Then, the crawlers 34 are powered to move the entire miner to the next desired mining location. The cutting heads 10 are moved before pivoting to the dotted line position illustrated in FIG. 3 for weight balance, etc.

It will thus be seen that according to the present invention an improved full face miner has been provided. While the invention has been herein shown and described in what is presently conceived to be the most practical and preferred embodiment thereof, it will be apparent to those of ordinary skill in the art the many modifications may be made thereof within the scope of the invention, which scope is to be accorded the broadest interpretation of the appended claims so as to encompass all equivalent structures and devices.

What we claim is:

1. A full face miner for mining a seam, comprising a pair of cutting heads rotatable about axes spaced from each other along the face being mined;

means for rotating each of said cutting heads axis to effect cutting;

means for mounting said cutting heads for reciprocal longitudinal movement toward and away from each other, to effect shearing, along the face being mined;

means for moving said cutting heads on said mounting means in reciprocal longitudinal movement to effect shearing;

means for supporting the roof of the cut seam and for anchoring said mounting means in stationary position within the seam during reciprocal movement of said cutting heads with respect to said mounting means;

means for sumping said cutting heads; and means for conveying cut material away from the face to be mined, said conveying means comprising means for conveying cut material along the face being mined, and means for conveying cut material away from and perpendicular to the face being mined; said means for conveying cut material along the face being mined consisting essentially of a plow operatively mounted to and longitudinally movable with each of said cutting heads.

2. A miner as recited in claim 1 wherein said means for conveying cut material away from and perpendicular to the face being mined comprises conveyor belt means stationarily mounted intermediate said cutting heads.

3. A miner as recited in claim 1 wherein said cutting heads are rotatable about generally vertical axes spaced from each other along the mine face.

4. A full face miner for mining a seam, comprising at least one cutting head, rotatable about an axis;

means for rotating said at least one cutting head about its axis to effect cutting;

means for mounting said at least one cutting head for reciprocal longitudinal movement along the mine face, to effect shearing, said means including two spaced end portions;

means for moving said at least one cutting head on said mounting means in reciprocal longitudinal movement to effect shearing;

means for supporting the roof of the cut seam and for anchoring said mounting means in stationary position generally parallel to the mine face during reciprocal movement of said at least one cutting head with respect to said mounting means;

means for sumping said at least one cutting head;

centrally located means for conveying means for conveying out material away from the mine face in a direction generally perpendicular thereto, the end portions of said cutting head mounting means located on opposite sides of said centrally located means; and means supporting said cutting head mounting means so that at least the end portions thereof are movable from a position generally parallel to the mine face to a position generally perpendicular to the mine face and extending in front of and in line with said central conveying means.

5. A full face miner for mining a seam, comprising at least one cutting head, rotatable about an axis;

means for rotating said at least one cutting head about its axis to effect cutting;

means for mounting said at least one cutting head for reciprocal longitudinal movement along the mine face, to effect shearing, said means including two spaced end portions;

means for moving said at least one cutting head on said mounting means in reciprocal longitudinal movement to effect shearing;

means for supporting the roof of the cut seam and for anchoring said mounting means in stationary position generally parallel to the mine face during reciprocal movement of said at least one cutting head with respect to said mounting means;

means supporting said cutting head mounting means so that at least the end portions thereof are movable from a position generally parallel to the mine face to a position generally perpendicular to the mine face;

powered motive means operatively connected to said cutting head mounting means for supporting and moving the entire miner; and means for mounting said powered motive means for movement from a first position wherein they are spaced from the ground with the end portions of said cutting head mounting means generally parallel to the mine face, to a second position wherein they are in operative engagement with the ground with the end portions of said cutting head mounting means extending generally perpendicularly to the mine face.

6. A miner as recited in claim 5 wherein said powered motive means comprise a crawler associated with each end of said cutting head mounting means.

7. A miner as recited in claim 5 wherein said powered motive means comprise a pair of wheels associated with each end of said cutting head mounting means.

8. A miner as recited in claims 5, 6, or 7 wherein said means for mounting said powered motive means comprise fluid-pressure actuated lift means.

9. A miner as recited in claim 5, further comprising centrally located conveying means, between said cutting head mounting means end portions, for conveying cut material away from the mine face in a direction generally perpendicular thereto, and wherein said cutting head mounting means supporting means comprise means for supporting said cutting head mounting means so that at least the end portions thereof are movable to a position extending in front of and in line with said central conveying means.

10. A miner as recited in claim 9 further comprising conveying means for conveying cut material along the face being mined, said conveying means consisting essentially of a plow operatively mounted to and longitudinally movable with said cutting heads.

11. A miner as recited in claim 10 wherein said at least one cutting head comprises a pair of cutting heads rotatable about axes spaced from each other along the face being mined; said cutting head mounting means mounting said cutting heads to form reciprocal movement toward and away from each other generally parallel to the face being mined.

12. A miner as recited in claim 4 further comprising conveying means for conveying cut material along the face being mined, said conveying means consisting essentially of a plow operatively mounted to and longitudinally movable with said cutting heads.

13. A miner as recited in claim 12 wherein said at least one cutting head comprises a pair of cutting heads rotatable about axes spaced from each other along the face being mined; said cutting head mounting means mounting said cutting to form reciprocal movement toward and away from each other generally parallel to the face being mined.

14. A miner as recited in claims 11 or 13 wherein said cutting heads are rotatable about generally vertical axes spaced from each other along the mine face.

15. A miner as recited in claims 1, 2, 3, 10, or 12 wherein a said plow is stationarily attached to each said cutting head and is disposed inwardly of said cutting head, both with respect to the face being mined and said means for mounting said cutting heads for movement along the face.

* * * * *